US006017164A

United States Patent [19]

Abbott

[11] Patent Number: 6,017,164

[45] Date of Patent: Jan. 25, 2000

[54] FOLIO WITH THREE-PART STIFFENER AND VIEWING POCKETS

[76] Inventor: Marc Dean Abbott, 17185 Walnut St., Yorba Linda, Calif. 92886

[21] Appl. No.: 09/153,584

[22] Filed: Sep. 15, 1998

[51] Int. Cl.[7] ..... B42D 3/00

[52] U.S. Cl. ..... 402/73; 281/29; 281/31; 281/36; 281/37

[58] Field of Search ..... 281/29, 31, 36, 281/37; 402/73

[56] References Cited

U.S. PATENT DOCUMENTS

| | | | |
|---|---|---|---|
| 643,866 | 2/1900 | Deckert . | |
| 2,054,793 | 9/1936 | Dewar . | |
| 2,092,541 | 9/1937 | Trussell . | |
| 2,704,546 | 3/1955 | Slonneger . | |
| 2,772,427 | 12/1956 | Rankin . | |
| 4,165,193 | 8/1979 | Gestetner . | |
| 4,629,349 | 12/1986 | Pitts | 281/31 |
| 5,711,627 | 1/1998 | Chapman . | |
| 5,762,375 | 6/1998 | Kogutt et al. | 281/29 |

*Primary Examiner*—Willmon Fridie, Jr.
*Assistant Examiner*—Mark T. Henderson
*Attorney, Agent, or Firm*—Gene Scott-Patent Law & Venture Group

[57] ABSTRACT

A folder or loose leaf type binder has a novel spine construction using a rigid sheet with a pair of spaced apart creases to form a spine stiffener with adjacent cover stiffeners. Since the cover stiffeners extend only partially into the cover portions of the folder, a natural break occurs in each of the two covers which, in turn, makes the folder easier to handle, prevents the covers from closing inadvertently, and allows the pages of the folder to lay at a preferred attitude and angle.

11 Claims, 3 Drawing Sheets

FOLIO WITH THREE-PART STIFFENER AND VIEWING POCKETS

BACKGROUND OF THE INVENTION

1. Field of the Invention

This invention relates generally to folders and binders, and more particularly to a binder having novel stiffener construction and clear pockets in both covers for insertion of indicia sheets.

2. Description of Related Art

The following art defines the present state of this field:

Deckert, U.S. Pat. No. 643,866 describes a new and Improved Copy-Book in which copies of letters and other documents can be made on the sheets of tissue-paper forming part of the book. This new way will be by the ordinary transfer of the inked writing or impressions from the original matter desired to be copied to the tissue-sheets of the book, such sheets being, as is customary, first dampened to receive such transfer, or copies of writings may be made upon the tissue-paper sheets of my book by placing under the sheet to be impressed an oiled-paper backing with a carbon-sheet interposed between the sheet to be written upon and the tissue-sheet upon which the carbon reproduction is to be made and then writing, and usual, on the letter-head sheet or other sheet in the usual manner where a transfer-sheet is employed. The construction of this book, in cooperation with its perforated leaves, is such as to permit of its use in another and novel manner-namely, the removal of the sheets from the book and the employment of same in a type-writing machine for the impression upon them of a carbon-copy of any desired writing from the original sheet and the subsequent reinsertion of the sheet in the book and the locking same therein by means of the locking device forming part of the book.

Trussell, U.S. Pat. No. 2,092,541 describes an invention that relates to improvements in the manufacture of book covers, and more particularly to an improved form of cover for a temporary, or loose-leaf, binder of the type in which the leaves are impaled upon rings or other fastening devices. Books of the above type are referred to include three essential parts, namely a cover, a baking plate, and a ring, or other form of leaf binding mechanism. In the manufacture of such books it has been the practice to form the cover and backing plate as one unit; and then to attach the binding mechanism to the backing plate. When the covers of such books are made of several plies of material, or of thick leather, which may be split, relatively little trouble is encountered in securing the backing plate to the cover. However, when the cover is made of thin leather, or of a single-ply leather substitute, then the problem of attaching the ring mechanism becomes more difficult One method of solving this difficulty is shown in U.S. Pat. No. 1,802,794 wherein the cover is grasped between the backing plate and the binding mechanism. In this form the exposed backing plate has been objected to as unsightly, and further, as constituting a menace to the highly polished surface of a desk or table on which the book rests. The invention provides a book cover made of single-ply material, or thin leather, in which no metal parts protrude through the cover. The book cover may be fabricated without including either the backing plate or the binding mechanism, whereby such covers may be conveniently stacked in flat form to await their use. An object of the invention is to provide a single-ply cover, which may be used with a spurred backing plate of the type shown in U.S. Pat. No. 1,790,799.

Dewar, U.S. Pat. No. 2,054,793 describes a loose-leaf binder, and particularly to a resilient, light weight cover for the same. An object of the invention is to provide inexpensive, resilient, light weight cover that will have the appearance of a conventional cover. Another object of the invention is to provide a resilient cover that will prevent the rings of the binder from bulging the outer surface of the binder out of shape at the points where the rings come in contact with the covers.

Rankin, U.S. Pat. No. 2,772,427 describes an invention in which the principal features include a novel backbone structure and a method for making such structures for use in books generally, and especially for so-called loose-leaf binders of a type having a ring-binder mechanism or the like riveted onto the backbone. A principal feature is a backbone structure fabricated from binder's board, according to a method of manufacture which produces a remarkable increase in strength at a cost which is negligible in view of the advantages gained and the superiority of the product as the durability, appearance, and enhanced utility. The invention provides an improved method of making a certain type of loose-leaf book case which utilizes existing machinery and processes up to the point of the improvement, to form the roughed black or flat casing in the usual manner, and thereafter adds certain steps and structural modifications to provide a casing having a much stronger backbone with a novel concealed rivet means. Another object is to improve the manufacture of paperboard book and binder casings to overcome the inherent structural weakness of the conventional rounded backbone made of binder's board and similar fibrous boards of the non-impregnated class, by making the backbone of two pre-formed backbone strips each of half weight of the companion cover boards, and joined by a hard-setting glue applied after the backbone pieces have been pre-rounded.

Slonneger, U.S. Pat. No. 2,704,546 describes improvements in binders and particularly ring-binders. Inside the covers of ring-binders shallow pockets are generally provided in which cards, loose papers and the like may be placed. If such a ring-binder is not carefully handled, the contents of these pockets spill out and may be lost. This invention provides a ring-binder having a pocket inside the front and back covers, thereof, the inside flap of each pocket having provisions for detachably securing it to the adjacent rings of the binder. This substantially closes the pocket and prevents the contents from spilling out regardless of how the binder is handled. The usual ring binder has its front and back covers made of an opaque material such as cardboard, leather or a plastic. This requires captions or pictures identifying contents of the binder to be stamped, printed or pasted on the binder cover and therefore limits the use of this particular binder to such material unless the original caption or picture is removed, which ordinarily would deface the cover and render the binder unfit for use. Another object of the present invention is to provide a ring-binder having front and back covers made of any suitable transparent material, each cover having an inner sheet attached thereto, forming a pouch or pocket into which may be inserted any desirable title sheet or picture. The transparent covers render these sheets clearly legible, thus not only identifying the contents of the binder, but also adding a decorative effect to the binder. When the front and back covers of the binder of a transparent material such as plastic, it is desirable for decorative and utility purposes to provide an opaque backing strip within the binder which will cover and hide the rings and their supporting member when the binder is closed This provides another advantage inasmuch as said opaque backing strip may be of a selected color, as for instance Air Force blue, thereby distinguishing the particular binder as especially dedicated to Air Force use. If the colored, opaque backing strip is extended to continue around the respective edges of the binder, a visible frame for any title sheet or picture within the transparent cover is provided.

Chapman, U.S. Pat. No. 5,711,627 describes a flexible spine binder with an open pocket extending the length of the spine and a stiff elongate member insertable into such pocket transforming the flexible spine into a stiff spine and also providing means for labeling the binder. The binder is made of film, vinyl, polypropylene or the like.

Pitts, U.S. Pat. No. 4,629,349 describes loose-leaf notebooks, report folders, and similar stationary items incorporating a deep pocket extending over the length of the item. A flexible transparent notebook of this design incorporates a pair of thermoplastic sheets, which are cut to the appropriate dimensions and heatsealed to form a pocket, which is coextensive with the outer notebook cover. A ring binder support is fastened to the center of one of the plastic sheets. Such notebooks, report folders, or the like may advantageously incorporate an auxiliary pocket affixed at one of the outer edges to permit folding along this edge. The notebook may be provided with an opaque cover by inserting on or more opaque sheets within the large outer pocket.

Gestetner, U.S. Pat. No. 4,165,193 describes a folder suitable, as a bank passbook for the retention or protection of sheets of paper or the like material comprising a pair of spaced post portions of snap fasteners near a fold line in the folder and attached to and projecting from one side of the folder and adapted to pass through holes in the sheets of paper, a pair of spaced cap portions of the snap fasteners adapted to cooperate with said post portions and removable to permit removal or insertion of sheets of paper from said folder, and a sheet of resilient, flexible plastic or like material affixed to and projecting from said folder at or about the fold line with one hole in register with each post portion and adapted to retain the sheets of paper loosely in position on the post portions when the cap portions are removed from the post portions.

The prior art teaches loose leaf folders, flexible transparent notebooks, and binders with stiffening means inserted therein. However, the prior art does not teach that a relatively inexpensive binder may be constructed with a three-panel stiffener sandwiched between a flexible outer covering so as to achieve a natural break in the covers of the binder. The prior art also fails to teach a binder construction providing clear window pockets in the manner of the present invention. The present invention fulfills these needs and provides further related advantages as described in the following summary.

SUMMARY OF THE INVENTION

The present invention teaches certain benefits in construction and use which give rise to the objectives described below.

The present invention provides a folder or loose leaf type binder having a novel spine construction using a rigid sheet with a pair of spaced apart creases to form a spine stiffener with adjacent cover stiffeners. Since the cover stiffeners extend only partially into the cover portions of the folder, a natural break occurs in each of the two covers which, in turn, makes the folder easier to handle, prevents the covers from closing inadvertently, and allows the pages of the folder to lay at a preferred attitude and angle.

A primary objective of the present invention is to provide a folder having advantages not taught by the prior art.

Another objective is to provide such a folder with an inexpensive and highly advantageous spine providing advantages in its use.

A further objective is to provide such a folder with clear window pockets so as to enable the use of indicia sheets for labeling both the interior as well as the exterior of the binder.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
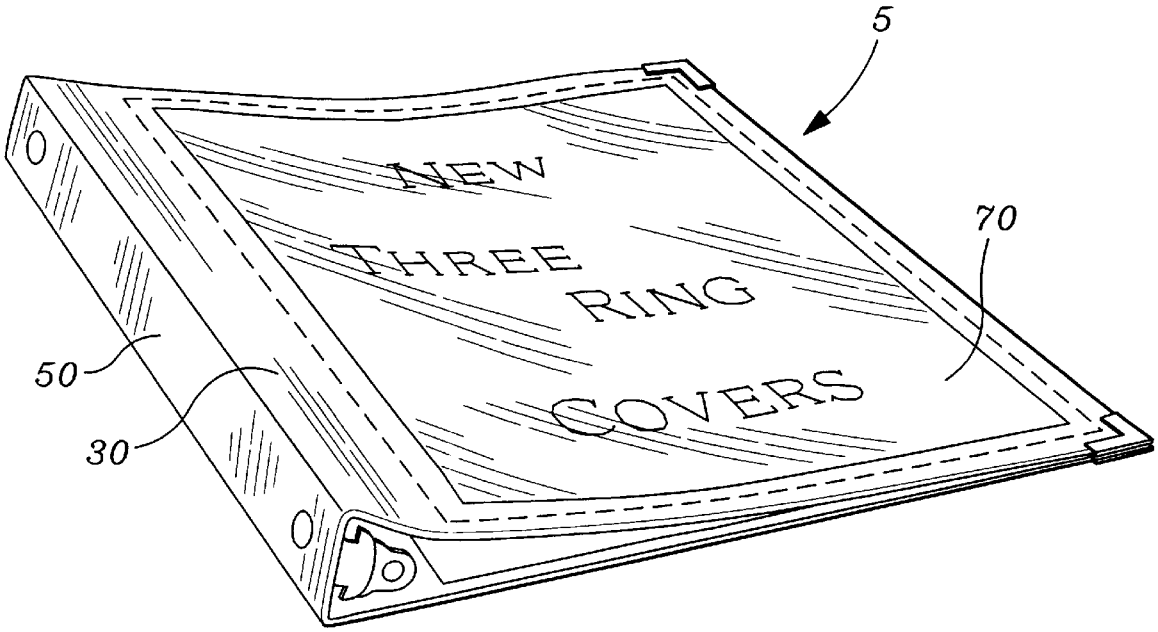
FIG. 1 is a perspective view of the preferred embodiment of the present invention shown in a closed posture.
Figure 2:
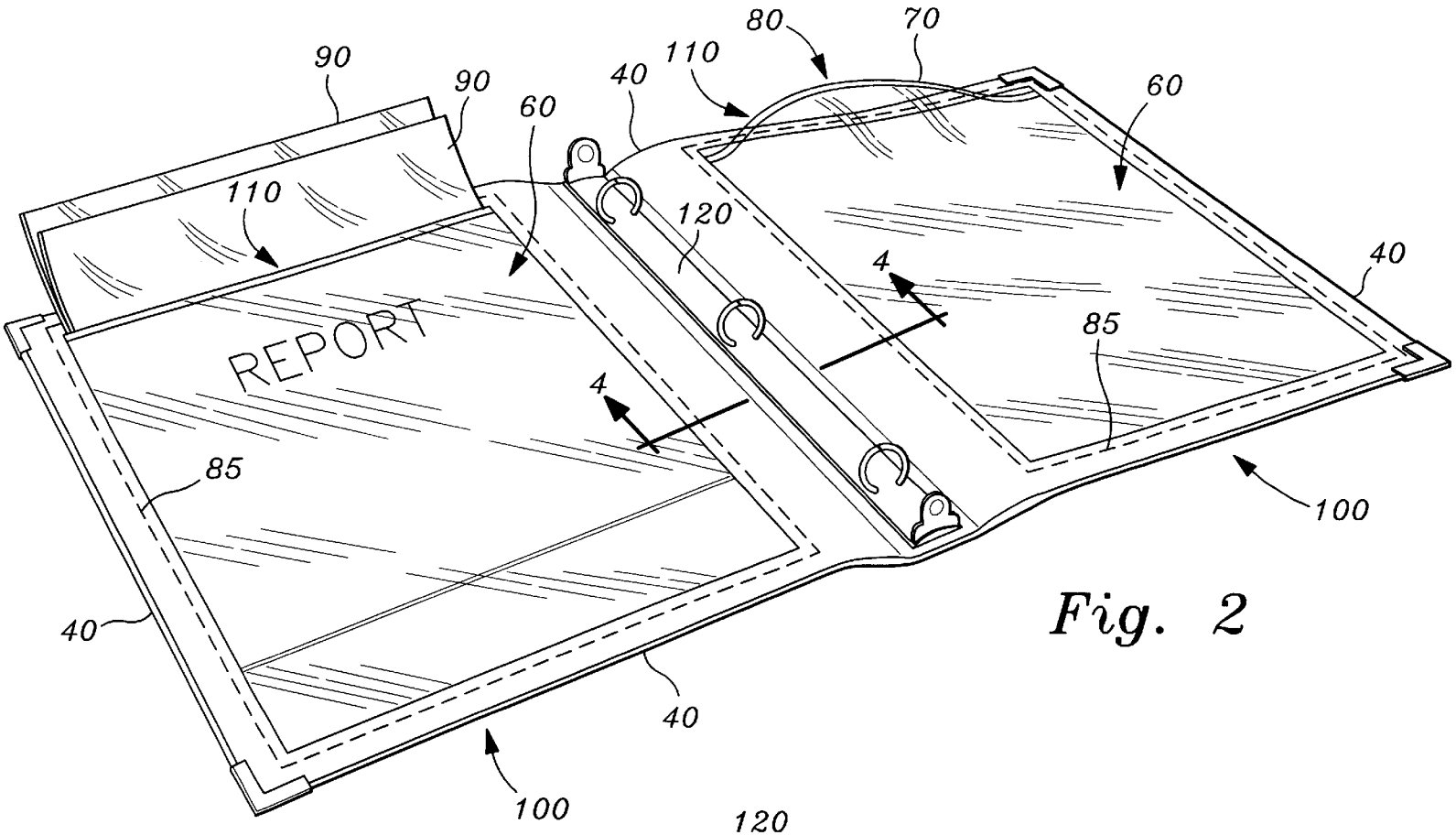
FIG. 2 is a perspective view thereof shown in an open posture.
Figure 3:
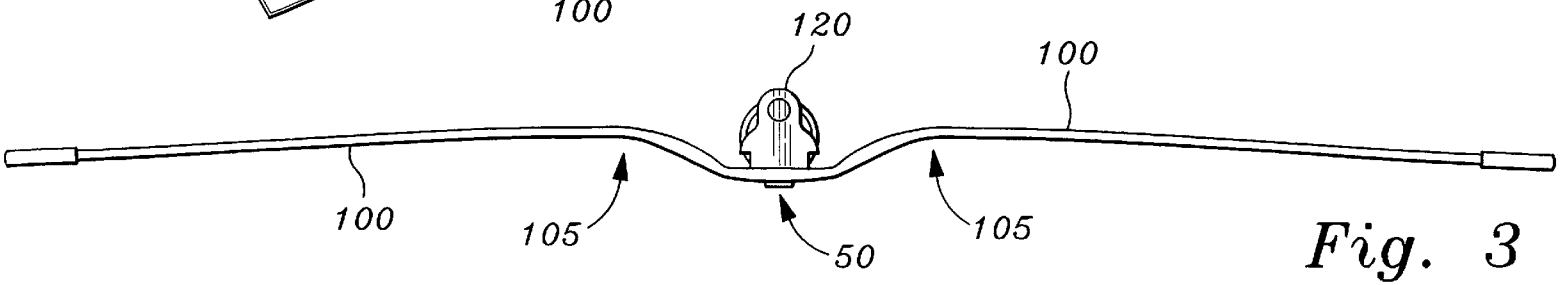
FIG. 3 is a side elevational view thereof.
Figure 4:
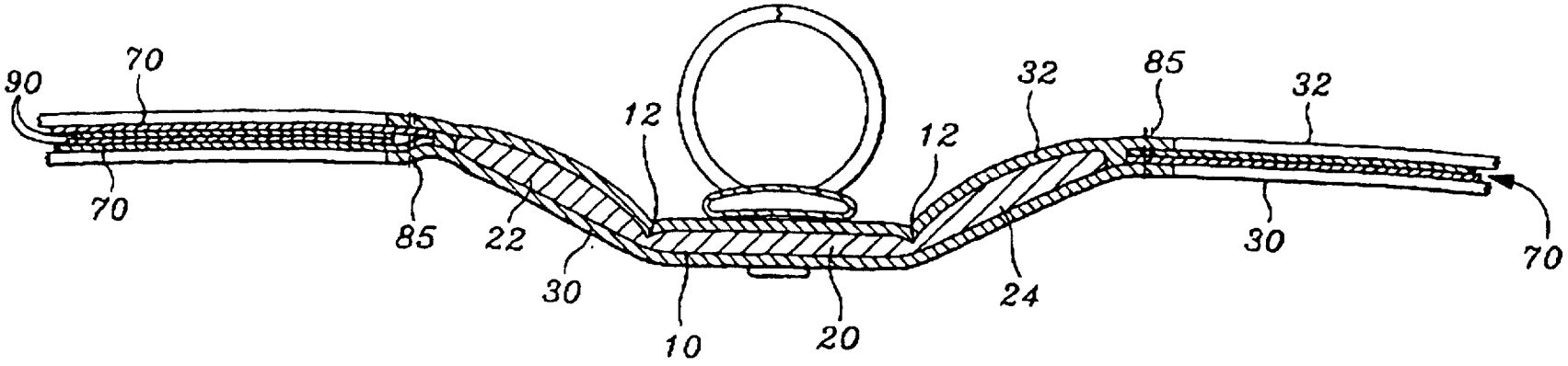
FIG. 4 is a partial sectional view thereof taken along line 4—4 in FIG. 2.

The above described drawing figures illustrate the invention, a folio apparatus 5 as seen in FIGS. 1 and 2, which may be constructed as a folder, a binder or any other similar type of device. As best seen in FIG. 4, the invention comprises a spine stiffener 10 of a stiff sheet material such as heavy cardboard or a plastic material, having a pair of parallel, spaced apart, linear creases 12 on a top surface thereof, the linear creases 12 enabling the spine stiffener 10 to be folded into three, preferably equal width portions, including a central portion 20 and two lateral portions 22 and 24 which are adjacent to the central portion 20. Such creases may also be advantageously constructed as living hinges in a material such as polypropylene. A pair of flexible sheets 30 and 32, preferably of vinyl, form an outer and an inner cover, i.e., cover layers, respectively, the covers defining a common peripheral edge 40, forming a perimeter of the folio apparatus as best seen in FIG. 2. The spine stiffener 10 is sandwiched between the outer and inner flexible sheets covers 30, 32 (outer and inner covers) with the central portion 20 of the spine stiffener 10 being positioned for defining a folio spine 50 as shown in FIG. 3. Preferably, although not necessarily, the flexible sheets 30, 32 provide a window 60 therein (FIG. 2), preferably open cutouts filled by a clear sheet 70, preferably clear acetate sheet or its equal, being fixedly engaged within the window 60 so as to form a pocket 80 for accepting an indicia sheet 90 within the pocket 80 for viewing the indicia sheet means 90 through the clear sheet 70. The pocket 80 is preferably formed as two, back-to-back sheets of the clear sheet 70, as best seen in FIG. 2. The indicia sheet 90 may be any common sheet or sheets of paper with appropriate markings printed on them. The two lateral portions 22, 24 of the spine stiffener 10 are foldable along the creases 12 at approximate right angles to the central portion 20 thereof for rigidizing the folio apparatus 5 as shown in FIG. 1.

The pocket means 80 may comprise a single pocket or a pair of pockets, preferably, one of the pockets being positioned in each of a pair of cover panels 100 of the apparatus 5 as clearly shown in FIG. 2. Preferably, the pocket 80 is formed by stitching (stitches shown as reference numeral 85) the clear sheet 70 into the cutouts in the cover panels 100 of the apparatus 5. An aperture 110 may be formed at the top, bottom or outer or inner edges of the pocket 80. It should be noted that the cover panels 100 have a natural break 105, i.e., a laying-over of the major portion of the cover panels 100 at the free edges of the two lateral portions of the spine stiffener 10. This makes the folio easier to handle and retards its inadvertent closure, i.e., tends to urge the folio's cover panels 100 to remain open when placed in that state.

The apparatus 5 may be configured with a conventional ring binder 120 engaged with the central portion 20 of the spine stiffener 10 as shown in FIG. 4.

In use, the invention is manipulated as any similar folio device except one or two sheets of paper with preferred indicia may be placed within the pocket 80 to provide titles and other indicia for labeling the apparatus. Because the pocket 80 is constructed to be transparent on both outside and inside, such indicia sheets may be seen from outside of the folio apparatus when the cover panels 100 are closed (FIG. 1), as well as from the interior when the cover panels are open (FIGS. 2 and 3).

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A folio apparatus comprising:

a spine stiffener of a stiff sheet material having a pair of parallel, spaced apart, linear creases on a top surface thereof, the linear creases enabling the spine stiffener to be folded into three portions including a central portion and two lateral portions adjacent to the central portion;

a pair of flexible sheets forming an outer and an inner covers, the covers defining a common peripheral edge of the folio apparatus;

the spine stiffener being sandwiched between the outer and inner flexible sheets, the central portion of the spine stiffener being positioned for defining a folio spine of the folio apparatus;

the flexible sheets providing a window therein, a clear sheet being fixedly engaged within the window so as to form a pocket for accepting an indicia sheet within the pocket for viewing the indicia sheet through the clear sheet;

the two lateral portions of the spine stiffener being foldable at approximate right angles to the central portion thereof for rigidizing the folio apparatus.

2. The apparatus of claim 1 wherein the pocket comprises a single pocket.

3. The apparatus of claim 1 wherein the pocket comprises a pair of pockets, one of the pockets being positioned in each of a pair of cover panels of the apparatus.

4. The apparatus of claim 1 wherein the pocket is formed by stitching the clear sheet into an aperture means in the cover panels of the apparatus.

5. The apparatus of claim 1 further comprising a ring binder engaged with the central portion of the spine stiffener.

6. A folio apparatus comprising:

a spine stiffener of a stiff sheet material having a pair of parallel, spaced apart, linear creases on a top surface thereof, the linear creases enabling the spine stiffener to be folded into three portions of approximately equal width, including a central portion and two lateral portions adjacent to the central portion;

a pair of flexible sheets forming an outer and an inner covers, the covers defining a common peripheral edge of the folio apparatus;

the spine stiffener being sandwiched between the outer and inner covers, the central portion of the spine stiffener being positioned for defining a folio spine of the folio apparatus, the lateral portions of the spine stiffener extending into the covers;

the flexible sheets providing a window therein, a clear sheet being fixedly engaged within the window so as to form a pocket for accepting an indicia sheet within the pocket for viewing the indicia sheet through the clear sheet;

the two lateral portions of the spine stiffener being foldable at approximate right angles to the central portion thereof for rigidizing the folio apparatus.

7. The apparatus of claim 6 wherein the pocket comprises a single pocket.

8. The apparatus of claim 6 wherein the pocket comprises a pair of pockets, one of the pockets being positioned in each of a pair of cover panels of the apparatus.

9. The apparatus of claim 8 wherein the pocket is formed by stitching the clear sheet into an aperture in the cover panels of the apparatus.

10. The apparatus of claim 6 further comprising a ring binder engaged with the central portion of the spine stiffener.

11. The apparatus of claim 8 wherein the cover panels provide a natural break causing a laying-over of a major portion of each of the cover panels at each corresponding one of a free edge of each of the two lateral portions of the stiffener so as to urge the cover panels to remain open when placed in that state.

* * * * *